US005176005A

United States Patent [19]

Kaplan

[11] Patent Number: 5,176,005

[45] Date of Patent: Jan. 5, 1993

[54] METHOD OF CONDITIONING AIR WITH A MULTIPLE STAGED DESICCANT BASED SYSTEM

[75] Inventor: Vladimir Kaplan, Silver Springs, Md.

[73] Assignee: Baltimore Aircoil Company, Baltimore, Md.

[21] Appl. No.: 917,430

[22] Filed: Jul. 23, 1992

Related U.S. Application Data

[62] Division of Ser. No. 719,921, Jun. 24, 1991.

[51] Int. Cl.[5] ..... F25D 17/02; F25D 23/00

[52] U.S. Cl. ..... 62/94; 62/92; 62/271; 62/311

[58] Field of Search ..... 62/94, 271, 91, 92, 62/311

[56] References Cited

U.S. PATENT DOCUMENTS

| | | | |
|---|---|---|---|
| 2,811,223 | 10/1957 | Newton | 62/92 |
| 2,926,502 | 3/1960 | Munters et al. | 62/271 X |
| 2,957,321 | 10/1960 | Munters et al. | 62/271 |
| 2,959,930 | 11/1960 | Munters | 62/271 X |
| 3,470,708 | 10/1969 | Weil et al. | 62/271 |
| 3,828,528 | 8/1974 | Weil | 62/94 X |
| 4,259,849 | 4/1981 | Griffiths | 62/94 X |
| 4,711,097 | 12/1987 | Besik | 62/271 |
| 4,952,283 | 8/1990 | Besik | 62/271 X |
| 4,982,575 | 1/1991 | Besik | 62/271 |
| 5,022,241 | 6/1991 | Wilkinson | 62/271 |

FOREIGN PATENT DOCUMENTS

| | | | |
|---|---|---|---|
| 688082 | 6/1964 | Canada | 62/94 |
| 4747136 | 10/1972 | Japan | 62/92 |
| 0210227 | 12/1982 | Japan | 62/92 |

*Primary Examiner*—Henry A. Bennet
*Assistant Examiner*—Chris Kilner
*Attorney, Agent, or Firm*—Edward J. Brosius; F. S. Gregorczyk; Thomas J. Schab

[57] ABSTRACT

The present invention describes a method and apparatus for conditioning air utilizing a desiccant based air conditioning system requiring substantially less regeneration energy than typical systems. This regeneration energy reduction is accomplished through the use of two separate desiccant devices and an indirect evaporative cooler having both a wet and dry side for air flow-through. The first desiccant device regeneration air is first passed through the wet side of the indirect evaporative cooler wherein it is humidified and heated. This air is then dehumidified by passing through the second desiccant device which operates at a high moisture content. This results in a substantial amount of moisture being absorbed from the first regeneration air stream causing a substantial air temperature increase and thereby, reducing the auxiliary heat required. The second desiccant device may be regenerated with ambient air.

16 Claims, 7 Drawing Sheets

METHOD OF CONDITIONING AIR WITH A MULTIPLE STAGED DESICCANT BASED SYSTEM

This is a division of application Ser. No. 719,921 filed on Jun. 24, 1991.

FIELD OF THE INVENTION

This invention relates to a method and apparatus for conditioning air. More specifically, this invention conditions air through the use of an improved desiccant based air conditioning system which requires substantially less energy to regenerate the desiccant than previously known systems.

BACKGROUND OF THE INVENTION

Desiccant based air conditioning systems have been finding increased usage during recent years. These systems have been used to solve certain HVAC problems that conventional vapor compression refrigeration systems are ill-equipped to handle. For example, desiccant based air conditioning systems have been used in applications where better humidity control is required. This is due to the fact that desiccant systems are capable of drying the air to a lower relative humidity than conventional system without frost development.

In addition, desiccant systems have been used where microbiological growth is a concern. Desiccant systems do not require the "wet surface" evaporator coil which is common to conventional systems. This coil, along with its associated condensate collection basin, can create a prime biological breeding ground. Also, tests have shown that some desiccant systems can effectively remove bacteria from the air stream with which the desiccant is brought in contact.

Desiccants can be solid, liquid, or gaseous substances which have as a basic characteristic the ability to attract and hold relatively large quantities of water. If, in attracting and holding moisture the desiccant undergoes a chemical change, the process is called absorption. If, in attracting and holding moisture the desiccant undergoes a physical change only, the process is called adsorption. In general, most absorbents are in liquid form and most adsorbents are in solid form.

In many commercial air-conditioning applications where desiccants are used, the desiccant is in solid form and adsorbs moisture from the air to be conditioned. Examples of these types of desiccants are silica gel, activated alumina, molecular sieves, or hygroscopic salts. In some cases, these desiccants are contained in "beds" over which the air to be conditioned is passed. Many times, however, the desiccant is contained in what is known as a "Desiccant Wheel".

A desiccant wheel is an apparatus typically comprising a plurality of closely spaced, very thin sheets of plastic or metal which are coated with a desiccant material. The wheel is contained in a duct system that is divided into two sections. The wheel is rotated slowly on its axis such that a given portion of the wheel is sequentially exposed to the two sections. In the first section, the desiccant is contacted by the process air, or the air to be cooled and dehumidified. In this section, the desiccant dehumidifies the process air by adsorbing moisture from this air.

In the second section of the desiccant wheel, the desiccant is contacted with the regeneration air. The regeneration air evaporates the moisture from the desiccant that the desiccant adsorbed from the process air, thereby regenerating the desiccant. By the wheel rotating through these two air streams, the adsorbing-/desorbing operation of the wheel is continuous and occurs simultaneously.

Generally, the typical system, as shown in Prior Art FIG. 4, operates by passing the air to be conditioned, or process air, through the dehumidification section of the desiccant wheel wherein the air is dehumidified and warmed. This warming occurs from the latent heat of the water adsorbed onto the desiccant and from the heat of adsorption generated by this process. Upon exiting the desiccant wheel, the process air passes through one side of an air-to-air heat exchanger. In this heat exchanger, the process air gives up some of the heat it picked up in the desiccant wheel to the air stream which is to be used to regenerate the desiccant wheel. After passing through the air-to-air heat exchanger, the process air is cooled by passing it through the dry side of an indirect evaporative cooler and then is humidified and further cooled by passing it through a direct evaporative cooler. The cool, moist air exiting the direct evaporative cooler is then supplied to the space to be conditioned. Part of the air leaving the space to be cooled is exhausted and makes up a portion of the regenerative air stream. The remaining exhaust air is recirculated and mixed with ambient air to make up the process air.

The desiccant used to dehumidify the process air must be periodically regenerated in order for it to remain effective at drying the process air. This regeneration is accomplished by passing warm or hot air through the wheel in order to evaporate the water from the desiccant into the air stream. In the typical system, this warm or hot air is made up of ambient air which is first passed through the air-to-air heat exchanger where it picks up some of the heat from the process air. The regenerative air stream is then passed through a heating apparatus to further heat the air before it enters the desiccant wheel. After heating, the regeneration air stream is passed through the regenerative section of the desiccant wheel in which it evaporates moisture from the wheel. The regenerative air stream is exhausted after it passes through the desiccant wheel.

Two general problems are associated with the typical desiccant based air conditioning systems. First, the air-to-air heat exchanger, which is used to transfer the heat energy from the dried process air leaving the desiccant wheel to the regeneration air stream, is costly. This drives up the first cost of the desiccant based air conditioning systems thereby limiting their application. In addition, the amount of heat recovered from the process air and transferred to the regeneration air stream typically only accounts for 30–35% of the total heat energy required for this regeneration air stream. Accordingly, the second problem associated with the typical desiccant system is that these systems require a significant amount of energy to sufficiently heat the regeneration air stream to allow it to effectively dry the desiccant. In some applications where there is a local supply of inexpensive fuel or if there is a supply of waste heat, this is not a problem. However, in the vast majority of applications this will be a significant disadvantage to the use of desiccant based air conditioning systems. A system which required less energy to regenerate the desiccant wheel would reduce the operating cost of desiccant based air conditioning systems thereby making them cost effective in a greater number of applications.

SUMMARY OF THE INVENTION

The present invention provides a desiccant based air conditioning system that does not require the expensive air-to-air heat exchanger which is common to conventional desiccant based systems. In addition, the desiccant based air conditioning system of the present invention requires significantly less energy to regenerate the desiccant than typical systems. In general, these features are accomplished by utilizing two different adsorbing means in order to make full use of the latent heat of the ambient air during the regeneration process.

The system of the present invention comprises two different adsorbing materials which could be contained in beds or on rotating desiccant wheels. In addition, the system comprises an indirect evaporative cooler whereby the process air can be cooled by passing through the dry side of the cooler. A direct evaporative cooler is also a part of the system. This direct evaporative cooler cools and humidifies the air being conditioned prior to the air being supplied to the space to be conditioned. The system also comprises a means of heating the air which is used for regenerating the desiccant which, in turn, is used to dehumidify the process air. This means of heating could be gas-fired, electric, or steam. However, the amount of heat that must be added in the present invention will be significantly less than the amount required in typical desiccant based air conditioning systems. Finally, the present system must also comprise a ducting means to transport the air streams to the various components of the present invention.

The present invention includes three basic air streams: a process air stream and two regeneration air streams. As mentioned previously, the typical desiccant based air conditioning system will only have two air streams comprising a process air stream and a single regeneration air stream. The process air stream in the present invention first is dehumidified and warmed by passing through the first adsorbing, or desiccant apparatus. This air stream is then cooled by passing through the dry side of the indirect evaporative cooled and then is humidified and further cooled by passing through the wet side of the direct evaporative cooler. Upon exiting the direct evaporative cooler, the process air is fully conditioned and is supplied to the space to be cooled and conditioned.

The first regeneration air stream is used to regenerate the desiccant that was used to dehumidify the process air stream. This air stream comprises ambient air that is first passed through the wet side of the indirect evaporative cooler wherein it becomes almost completely saturated with moisture and warmed due to the heat given up by the process air on the dry side of the indirect evaporative cooler. Upon exiting the wet side of the indirect evaporative cooler, the first regeneration air stream is contacted with a second desiccant means whereby the first regeneration air stream is dehumidified. This second desiccant means will typically operate at a higher moisture content than the first desiccant means. Because the first regeneration air stream was almost completely saturated with moisture when it entered the second desiccant means, the temperature of this air stream after leaving the desiccant after dehumidification will be substantially increased due to the latent heat of vaporization and the heat of adsorption that is generated during the adsorbing process and is transferred to the first regeneration air stream. As a result, when the first regeneration air stream leaves the second desiccant means and enters the heating means, the amount of heat that must be added to the air is substantially less than what would otherwise have to have been added in a typical system. Upon exiting the heating means, the regeneration air stream is brought in contact with the first desiccant means. When this occurs, the regeneration air stream evaporates the moisture from the first desiccant that was adsorbed in the process of dehumidifying the process air. The first regeneration air stream is exhausted upon exiting the first desiccant means.

The second regeneration air stream is used to regenerate the second desiccant that was used to dehumidify the first regeneration air stream. The second regeneration air stream is made up entirely of ambient air. Because the second desiccant operates at a high moisture content, the air to regenerate this desiccant need not be as hot or dry as is typically required to regenerate desiccants which operate at lower moisture contents. In fact, ambient air is usually sufficient to evaporate the moisture from the second desiccant that wa adsorbed from the first regeneration air stream. Although heating the ambient air used to regenerate this second desiccant is usually not necessary, in some cases where the ambient air is cold or humid, such as during the winter time, some heating may be required.

The present invention improves upon the typical desiccant based air conditioning system in several important ways. First, the need for the air-to-air heat exchanger is eliminated in the present invention. Instead, the heat of the process air leaving the first desiccant is transferred to the regeneration air stream in the indirect evaporative cooler. The elimination of this heat exchanger will lower the first cost of the present desiccant based air conditioning system.

In addition, the present invention requires substantially less regeneration energy than typical desiccant based air conditioning systems. As a result, the size of the heating apparatus will be reduced, but more importantly, the cost to operate the present invention will be significantly less. This lower operating cost will likely allow the desiccant system of the present invention to be cost effective in many cases where typical desiccant systems were not.

BRIEF DESCRIPTION OF THE DRAWINGS

In the drawings.

FIG. is a schematic of a desiccant based air conditioning system utilizing desiccant wheels in accordance with the present invention.

DETAILED DESCRIPTION

Figure 1:
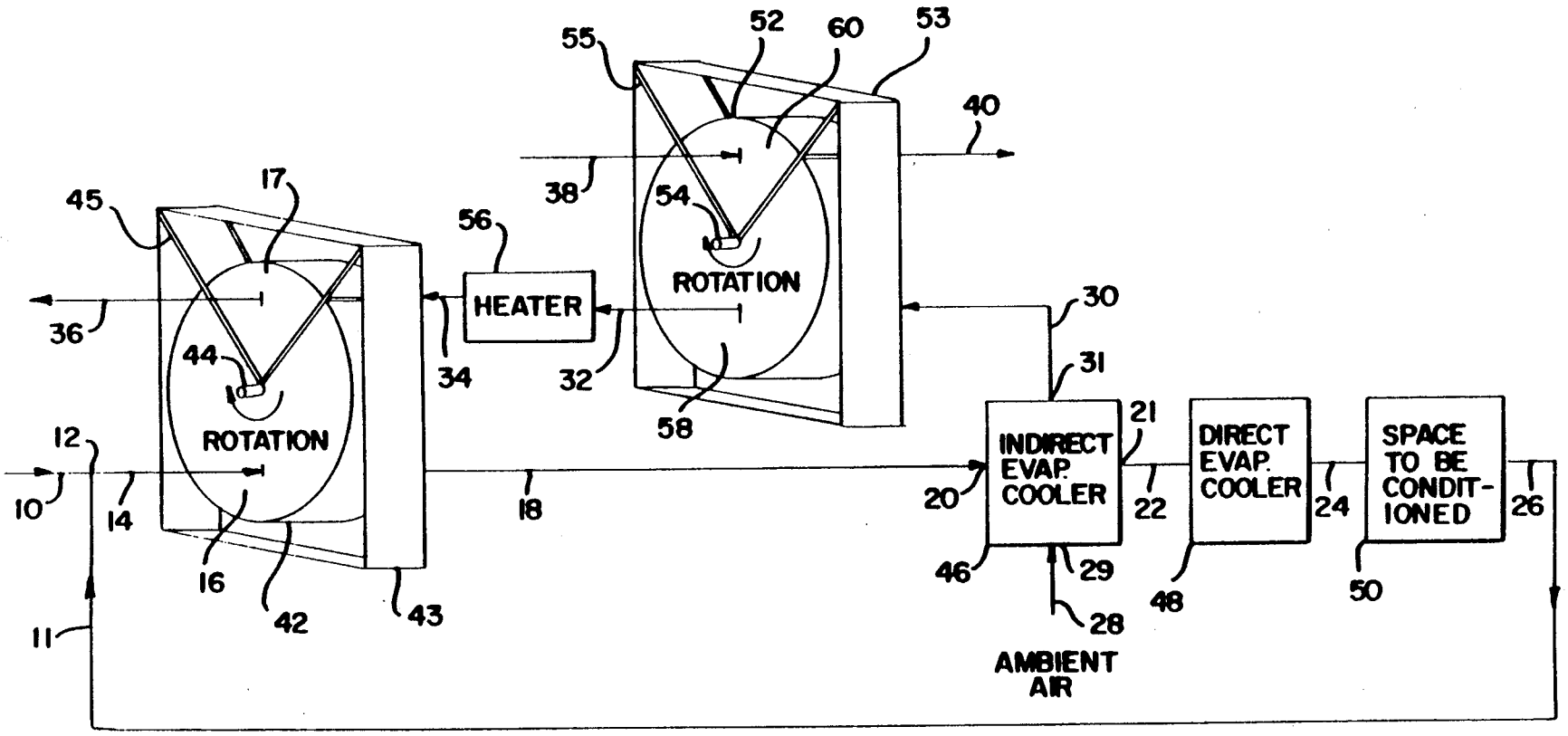

Referring now to FIG. 1, there is shown a schematic of the preferred embodiment of the desiccant based air conditioning system of the present invention. In general, it will be seen from this schematic that there are three main air streams: the process air stream, the first regeneration air stream, and the second regeneration air stream. The main components of this system include a first desiccant wheel 42. First desiccant wheel 42 typically comprises a plurality of desiccant coated substrates which are arranged in a rotating wheel apparatus. These substrates are generally designed to provide the greatest possible surface area to maximize the contact area for the desiccant and the air stream passing therethrough. Common substrate shapes include a honeycomb arrangement and an arrangement comprising a plurality of thin plastic sheets of increasing radius of curvature and arranged concentrically around the axis of the wheel. These wheels typically range in size from about 3 feet to over 13 feet in diameter and from about one or two inches to over one foot wide. A desiccant wheel is generally coupled to an electrically driven motor which rotates the wheel at speeds ranging from about one or two revolutions per minute up to about 20 revolutions per minute. The desiccant affixed to wheel 42 could be selected from a number of different desiccant materials including silica gel, activated alumina, molecular sieves, and hygroscopic salts.

Desiccant wheel 42 is placed within an air duct 43 containing a duct divider 45. Duct divider 45 typically comprises a sheet metal form which divides the space within the duct in a "V" notch shape. Duct divider 45 divides duct 43 and hence, desiccant wheel 42, into two sections. Desiccant wheel 42 is divided such that section 16 of the wheel will comprise the dehumidification section of the wheel and will be exposed to the section of duct 43 containing the process air and such that section 17 of the wheel will comprise the regeneration section of the wheel and will be exposed to the section of duct 43 containing the regeneration air. Desiccant wheel 42 rotates about axis 44 such that a given portion of the wheel first is exposed to the section of duct 43 containing the process air stream 14 and thus is a part of the dehumidification section 16 of the wheel. As the wheel rotates, this portion of the wheel is then exposed to the section of duct 43 containing the regeneration air stream 34 and thus is a part of the regeneration section 17 of the wheel.

The system of the present invention also includes an indirect evaporative cooler 46. This cooler has a dry side through which process air may pass and it has a wet side through which regeneration air may pass. The air streams flowing through the dry and wet sides of this cooler do not directly contact each other. Typical indirect evaporative coolers may be of either the integrated type or the separated type. In the integrated type of indirect evaporative cooler, a single heat transfer media is utilized within a single enclosure. This media is configured such that one side is wetted and allows circulatinq water to directly contact an air stream passing therethrough. The other side of the media is not wetted and the air passing through does not directly contact any water. In addition, the air streams on the wetted side and on the dry side are separated by the media and are not allowed to contact each other. In the separated type of indirect evaporative cooler, a cooling tower is employed for the wet air stream. The water from the cooling tower is circulated through a finned coil which is contained in a separate enclosure through which the dry air stream would flow.

The outlet of the dehumidification section 16 of desiccant wheel 42 is connected to the dry side inlet 20 of indirect evaporative cooler 46. The outlet of the dry side of indirect evaporative cooler 46 is connected to the inlet of direct evaporative cooler 48. In passing through direct evaporative cooler 48, the process air stream is brought in direct contact with cooling water. Direct evaporative coolers commonly use a single heat transfer media which allows for direct contact between the air stream flowing through the cooler and the water being recirculated in the cooler. Direct evaporative coolers are commonly referred to evaporative coolers in the industry. The outlet of direct evaporative cooler 48 is connected to the space to be conditioned.

As stated previously, indirect evaporative cooler 46 also has wet side through which air passes. The wet side inlet 29 of indirect evaporative cooler 46 is connected to a supply of ambient air 28 which makes up the first regeneration air stream. The wet side outlet 31 of indirect evaporative cooler 46 is connected to a second desiccant wheel 52.

Second desiccant wheel 52 is of a design similar to that of first desiccant wheel 42. However, the desiccant contained on second desiccant wheel 52 will generally have a higher moisture retention capacity than will the desiccant contained on first desiccant wheel 42. However, the desiccant affixed to second desiccant wheel 52 could also be selected from a group of desiccant including silica gel, activated alumina, molecular sieves, and hygroscopic salts.

Second desiccant wheel 52 is placed within an air duct containing a duct divider 55. Duct divider 55 is of the same general type as duct divider 45 previously described. Duct divider 55 divides duct 53 and hence, second desiccant wheel 52 into two sections. Section 58 of the wheel will comprise the dehumidification section of the wheel and will be exposed to the section of duct 53 containing first regeneration air stream 30. Section 60 of the wheel will comprise the regeneration section of the wheel and will be exposed to the section of duct 53 containing second regeneration air stream 38. Second desiccant wheel 52 rotates about axis 54 such that a given portion of the wheel first is exposed to the section of duct 53 containing first regeneration air stream 30 and thus is a part of dehumidification section 58 of the wheel. As the wheel rotates, this portion of the wheel is then exposed to the section of duct 53 containing second regeneration air stream 38 and thus is a part of regeneration section 60 of the second desiccant wheel 52.

The outlet of dehumidification section 58 of second desiccant wheel 52 is connected to the inlet of air heating apparatus 56. This heatinq apparatus could be of several different conventional types such as direct gas fired, steam pipe, and electrical resistance. Generally, however, the heating apparatus of the present invention will be smaller than the heating apparatus required for typical desiccant systems because the amount of heat that is required in the present invention to heat the first regenerative air stream is significantly reduced. The outlet of air heating device 56 is connected to the regeneration section 17 of the first desiccant wheel 42.

Still referring to FIG. 1, the operation of the present invention will now be described. The process air stream is made up of ambient air 10 and recirculated air 11.

Typically, the ambient air stream will constitute about 25% and the recirculated air about 75% of this process air stream. These two air streams are mixed at point 12 to form the process air stream 14. Process air stream 14 enters the dehumidification section 16 of first desiccant wheel 42. While passing through this section, the desiccant adsorbs moisture from the process air stream thereby dehumidifying it. As a result of this process, the temperature of the process air stream is significantly increased due to the latent heat of the moisture adsorbed and the heat of adsorption that is generated. The hot, dry air stream 18 leaving first desiccant wheel 42 then enters the dry side of indirect evaporative cooler 46 through inlet 20 wherein it is cooled. Upon exiting indirect evaporative cooler 46 at dry side exit 21, the process air stream passes through direct evaporative cooler 48 wherein the process air is adiabatically saturated thereby humidifying and further cooling the process air. Upon exiting direct evaporative cooler 48, the process air is fully conditioned and can be supplied to the space to be conditioned 50. Typically, the space to be conditioned will be an office building, grocery store, or some other area requiring a supply of cool air. In this space to be conditioned, both heat and moisture are added to the air stream. Upon exiting this space, a portion of the process air is exhausted and a portion is recirculated. Recirculated air stream 11 is mixed with ambient air 10 to comprise process air stream 14. The amount of the air that is exhausted and the amount of ambient air 10 which is taken in will be equivalent in order to maintain a constant air flow rate through the system.

The first regeneration air stream is made up entirely of ambient air 28. Ambient air 28 first passes through the wet side of indirect evaporative cooler 46 wherein the air stream is place in direct contact with the circulating water of the cooler. By this process, the ambient air becomes saturated with moisture and picks up the heat which had been transferred to the circulating water from the process air stream flowing throuqh the dry side of indirect evaporative cooler 46. Upon exiting the wet side of cooler 46 at 31, the first regeneration air stream passes through dehumidification section 58 of second desiccant wheel 52. As stated previously, the desiccant affixed to this wheel will normally operate at a higher moisture content than the desiccant affixed to the first desiccant wheel 42.

When the second desiccant is contacted by the warm and humid first regeneration air stream, the desiccant adsorbs moisture from the air stream thereby dehumidifying and heating this air stream. Because first regeneration air stream 30 is almost completely saturated with moisture when it enters the second desiccant wheel 52 and because the desiccant affixed to second desiccant wheel 52 operates at a high moisture content, second desiccant wheel 52 adsorbs a substantial amount of moisture from first regeneration air stream 30. Since the amount of heat generated by the adsorption process is directly related to the amount of moisture that is adsorbed, the amount of heat given off by this process and transferred to first regeneration air stream 30 is also substantial. As a result, the temperature of first regeneration air stream 30 upon leaving second desiccant wheel 52 at 32 will be significantly increased by this process.

Upon leaving dehumidification section 58, the first regeneration air stream now at 32 then passes through heating means 56 wherein additional heat is added to the air stream to effect an additional increase in temperature of this air stream. However, since the temperature of first regeneration air stream 30 had previously been significantly increased as exiting stream 32 due to the adsorption process of second desiccant wheel 52, the amount of heat that must be added by heater 56 is much less than would otherwise need to be added in a typical system.

After passing through heater 56, the hot, dry first regeneration air stream now at 34 is passed through regeneration section 17 of the first desiccant wheel. When the desiccant in this section is contacted by hot and dry first regeneration air stream 34, the moisture that the desiccant had adsorbed from the process air stream is evaporated from the desiccant and is carried away. First regeneration air stream is exhausted as exhaust stream 36 upon leaving dehumidification section 17 of first desiccant wheel 42.

Second regeneration air stream 38 is also made up of ambient air. This air stream is passed through regeneration section 60 of second desiccant wheel 52. Since the desiccant affixed to second desiccant wheel 52 operates at a high moisture content, the air needed to regenerate the desiccant affixed to second desiccant 52 need not be at the high temperatures commonly required for typical regeneration processes. As a result, the ambient air will, in most cases, evaporate the moisture from second desiccant wheel 52 when it is brought in contact with the desiccant. There may, however, be some instances where a minimal amount of heat will need to be added to the ambient air to enable it to fulfill its regeneration function. Typically, this could occur in cases where the ambient air is cold or humid, such as during the winter months.

Figure 2:
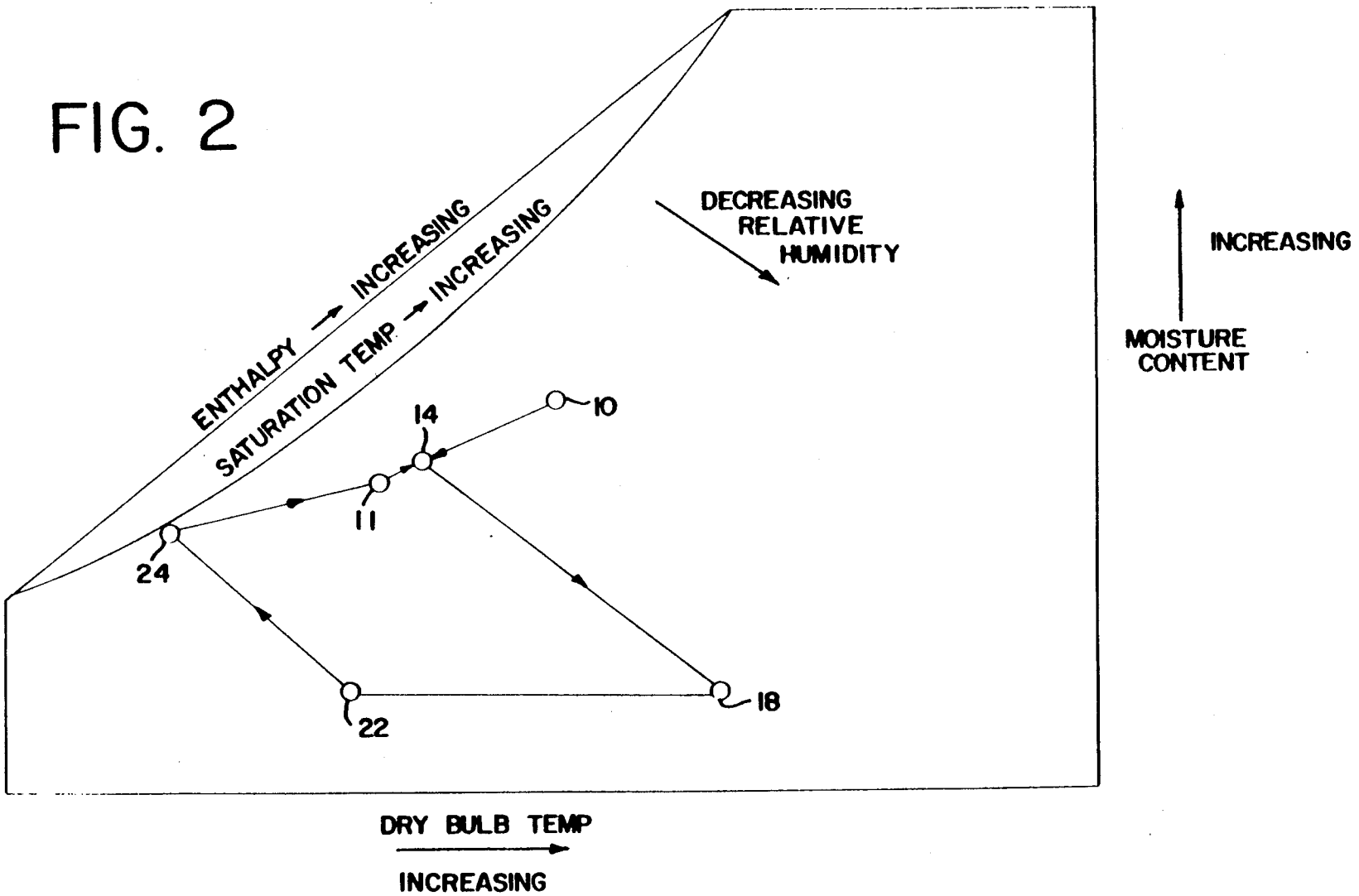
FIG. 2 is a psychrometric diagram showing the path of the process air stream of the present invention.

FIG. 2 is a Psychrometric Diagram showing the conditions of the process air at the various stages of conditioning by the present invention. A psychrometric diagram shows the thermodynamic properties and relationships of moist air. This diagram has Moisture Content as its ordinate, Dry Bulb Temperature as its abscissa, and has both Enthalpy and Saturation Temperature scales bordering its upper left hand corner.

The reference numerals shown on FIG. 2 directly correlate to the reference numerals used to describe the system of FIG. 1. As a result, the condition of the process air at each stage of the system of the present invention shown by FIG. 1 can be determined from referencing FIG. 2.

Referring now to FIG. 2, the conditions of the process air at each step of its conditioning by the present invention will be explained. Process air 14 is comprised of ambient air 10 and recirculated air 11. The process air 14 first is contacted with the first desiccant which adsorbs moisture from the process air. As a result of this process, the process air is dehumidified and the dry bulb temperature of the air is increased due to the latent heat of vaporization and the heat of adsorption that is generated. When the process air leaves the first desiccant, it is at condition 18 shown on the psychrometric diagram. The process air is then passed through the dry side of the indirect evaporative cooler in which the process air is cooled but no moisture is added to the air stream. This operation is shown as a horizontal line, or constant moisture content, between points 18 and 22 on the psychrometric diagram given in FIG. 2. The process air leaves the indirect evaporative cooler at condition 22 and enters the direct evaporative cooler wherein the process air is adiabatically saturated to condition 24. The process air at condition 24 is fully conditioned and can be supplied to the space requiring cooling. In the space to be cooled, both heat and moisture are added to the process air. Upon leaving the space to be cooled, the process air is at condition 11. A certain portion of this air is recirculated and mixed with ambient air 10 to maintain a steady flow of process air 14 through the system.

Figure 3:
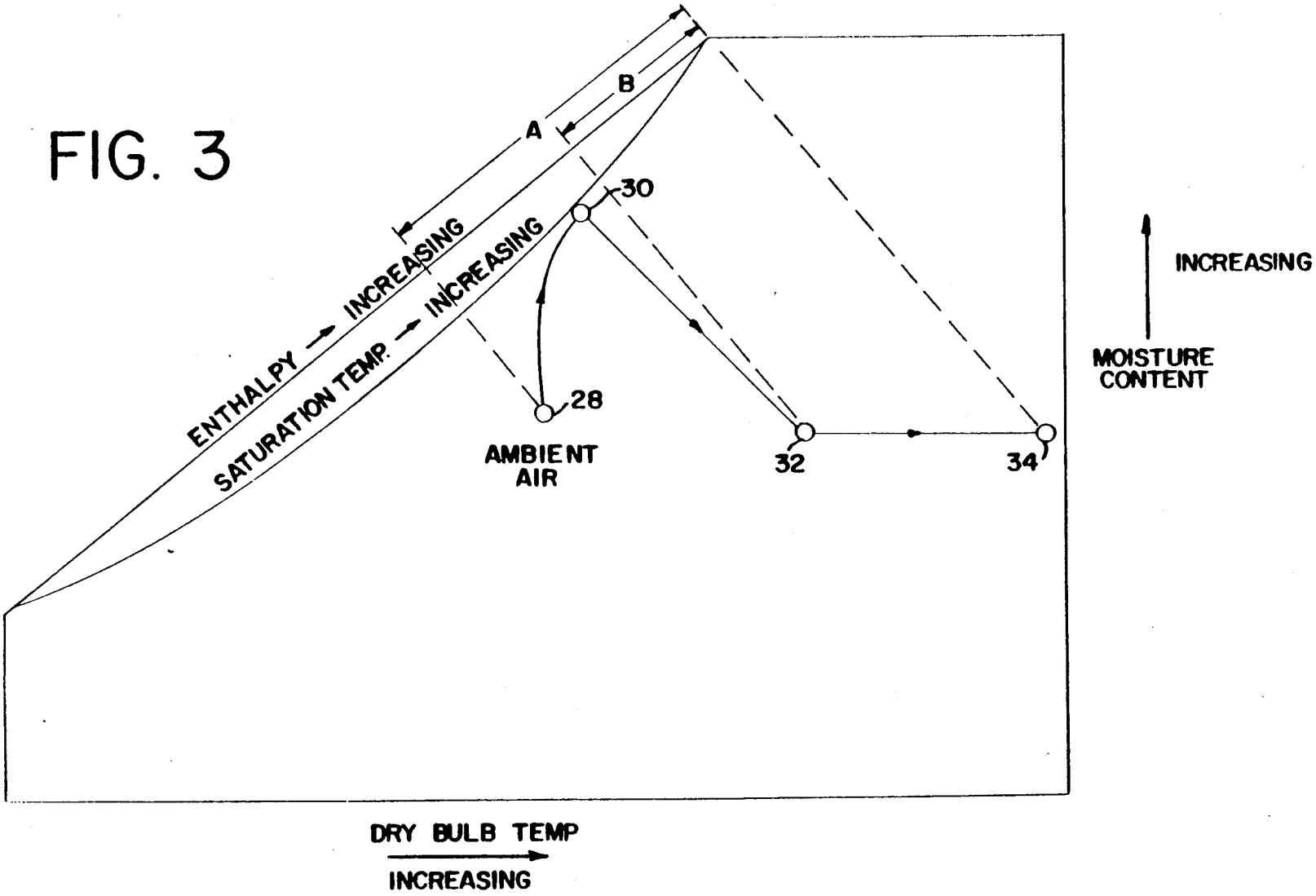
FIG. 3 is a psychrometric diagram showing the path of the first regeneration air stream in the desiccant system of the present invention.

FIG. 3 is a Psychrometric Diagram showing the conditions of the first regeneration air stream at the various stages of the present invention. Again, the reference numerals used for FIG. 3 directly correspond to the reference numerals shown for the present invention in FIG. 1. As a result, the condition of the first regeneration air stream at each stage of the system of the present invention shown by FIG. 1 can be determined from referencing FIG. 3.

Referring now to FIG. 3, the conditions of the first regeneration air stream will be explained. The first regeneration air stream is comprised entirely of ambient air 28. This air stream is first passed through the wet side of the indirect evaporative cooler and is therefore, placed in direct contact with the recirculating water of this cooler. By this process, the first regeneration air stream becomes almost completely saturated with moisture and absorbs the heat from the recirculated water that was transferred from the process. The exact path that the first regeneration air stream follows during this process depends upon the various operating conditions of the system. The path shown on FIG. 3 between point 28 and point 30 is representative of this process. As can be seen from this chart, the air at condition 30 has both greater moisture content and greater enthalpy, or heat, than did the air entering the indirect evaporative cooler at condition 28.

Upon exiting the wet side of the indirect evaporative cooler at condition 30, the first regeneration air stream enters the dehumidification section of the second desiccant wheel. In contacting the desiccant, the desiccant adsorbs moisture from the first regeneration air stream which dehumidifies the air and increases its temperature due to the latent heat and heat of adsorption generated by this drying process. The first regeneration air stream exits the second desiccant wheel at condition 32, a condition of lower moisture content but increased dry bulb temperature, and enters the heating device. While passing through this device, the temperature of the first regeneration air stream is increased further while the moisture content of the air remains constant. The first regeneration air stream exits the heater at condition 34, which is the condition required to regenerate the first desiccant.

The amount of heat that must be added to the first regeneration air stream in the present invention can be seen by referring to FIG. 3. The total regeneration energy required to condition the first regeneration air stream from condition 28 to condition 34 is shown as "A" on this diagram. However, in the present invention, this entire amount of heat does not need to be added by the heating means. Rather, the first regeneration air stream is heated from condition 28 to condition 32 by humidifying and heating the first regeneration air stream on the wet side of the indirect evaporative cooler and then by drying this air stream in second desiccant wheel. As a result, the present invention only requires that sufficient external energy be added in the heating means to raise the temperature of the first regeneration air stream from condition 32 to condition 34, which is shown on the diagram as "B".

Figure 4:
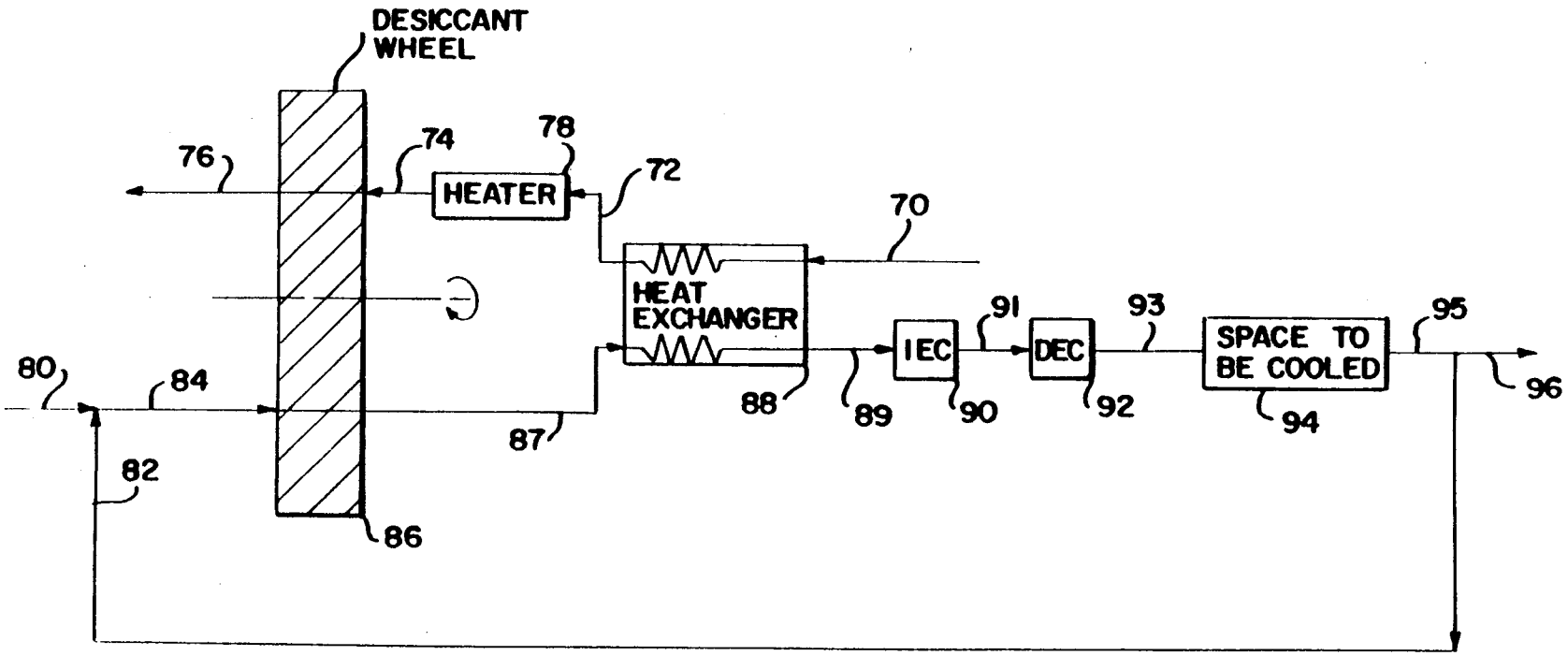
FIG. 4 PRIOR ART
FIG. 4 is a Prior Art Figure showing a schematic of a typical desiccant based air conditioning system utilizing a single desiccant wheel.

Prior Art FIG. 4 is a schematic diagram of a typical desiccant based air conditioning system. As described previously, the typical system will comprise a desiccant wheel 86, an air-to-air heat exchanger 88, an indirect evaporative cooler 90, a direct evaporative cooler 92, and a heating device 78. Process air 84 is typically comprised of ambient air 80 and recirculated air 82. Process air 84 first passes through desiccant wheel 86 whereby process air 84 is dehumidified and heated. Upon leaving desiccant wheel 86, process air at 87 passes through air-to-air heat exchanger 88 wherein a portion of the heat from the process air is transferred to regeneration air stream 70. Upon exiting air-to-air heat exchanger 88, process air at 89 is cooled by passing through indirect evaporative cooler 90 and then is cooled further and humidified by passing through direct evaporative cooler 92. Upon leaving direct evaporative cooler 92, process air at 93 is fully conditioned and is supplied to the space to be cooled 94. In the space to be cooled, process air increases in heat and moisture content and exits at 95. A portion of process air is exhausted at 96 and the remaining process air is recirculated as stream 82.

Still referring to Prior Art FIG. 4, regeneration air stream 70 is comprised of ambient air which is first passed through air-to-air heat exchanger 88 wherein it picks up heat from the process air stream. Upon exiting air-to-air heat exchanger 88, regeneration air stream now at 72 is heated further by passing through heating device 78. Upon exiting heating device 78, regeneration air stream 74 is capable of performing its intended regeneration function and is passed through desiccant wheel 86 wherein it evaporates moisture from desiccant wheel 86. Upon exiting desiccant wheel 86, regeneration air stream 76 is exhausted.

Figure 5:
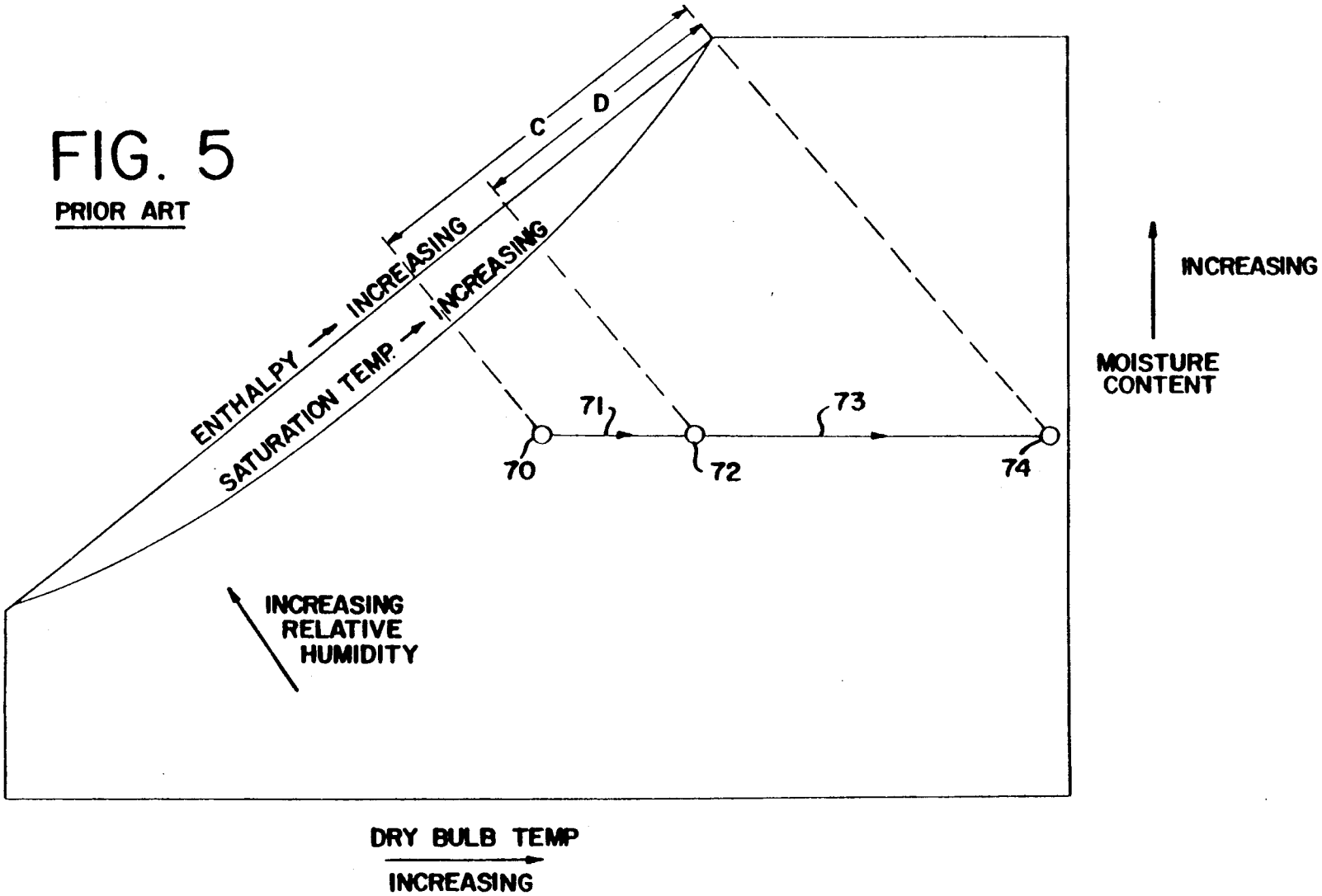
FIG. 5 PRIOR ART
FIG. 5 is a Prior Art Figure of a psychrometric diagram showing the path of the regeneration air stream in a typical desiccant system.

The amount of external heat energy that must be added to the regeneration air stream by heating device 78 in a typical desiccant based air conditioning system can be seen from FIG. 5. Shown on FIG. 5 is a psychrometric diagram on which the path of the conditions of the typical system regeneration air stream is plotted. The reference numerals utilized on FIG. 5 directly correspond to the reference numerals which were used to describe the regeneration air stream of the typical system shown on FIG. 4. As a result, the condition of the typical system regeneration air stream at each stage of the typical system shown by FIG. 4 can be determined from FIG. 5.

Referring to FIG. 5 and as described above, the regeneration air stream in a typical system is made up of ambient air 70. This air is first passed through an air-to-air heat exchanger in which it picks up heat from the process air which is shown a path 71. Upon exiting the air-to-air heat exchanger at condition 72, the regeneration air must then pass through a heating device, shown as path 73. The regeneration air stream exits the heating device at condition 74 at which it is fully capable to act as regeneration air.

The total amount of regeneration energy that must be added in the typical system is equal to the difference in enthalpy between conditions 70 and 74. This difference is shown as "C" on FIG. 5. The amount of external heat that must be added to the regeneration air stream by the heating means in the typical system is equal to the difference in enthalpy of the air between condition 72 and condition 74. This amount of heat is shown on the diagram as "D". As shown by FIG. 5 the amount of external heat that must be added by the heating device in the typical system, shown as "D" on FIG. 5, constitutes approximately 70% of the total heat required, "C". This is substantially more than the amount of external heat that is required in the present invention. In fact, referring back to FIG. 3, it is shown that the amount of external heat that must be added by the heating device in the system of the present invention, shown as "B", constitutes only about 50% of the total heat required in the present invention, shown as "A". This reduction in the amount of external heat required will significantly reduce the operating costs of the system of the present invention when compared to the typical system, thereby making the system of the present invention more cost effective in a greater number of applications.

Figure 6:
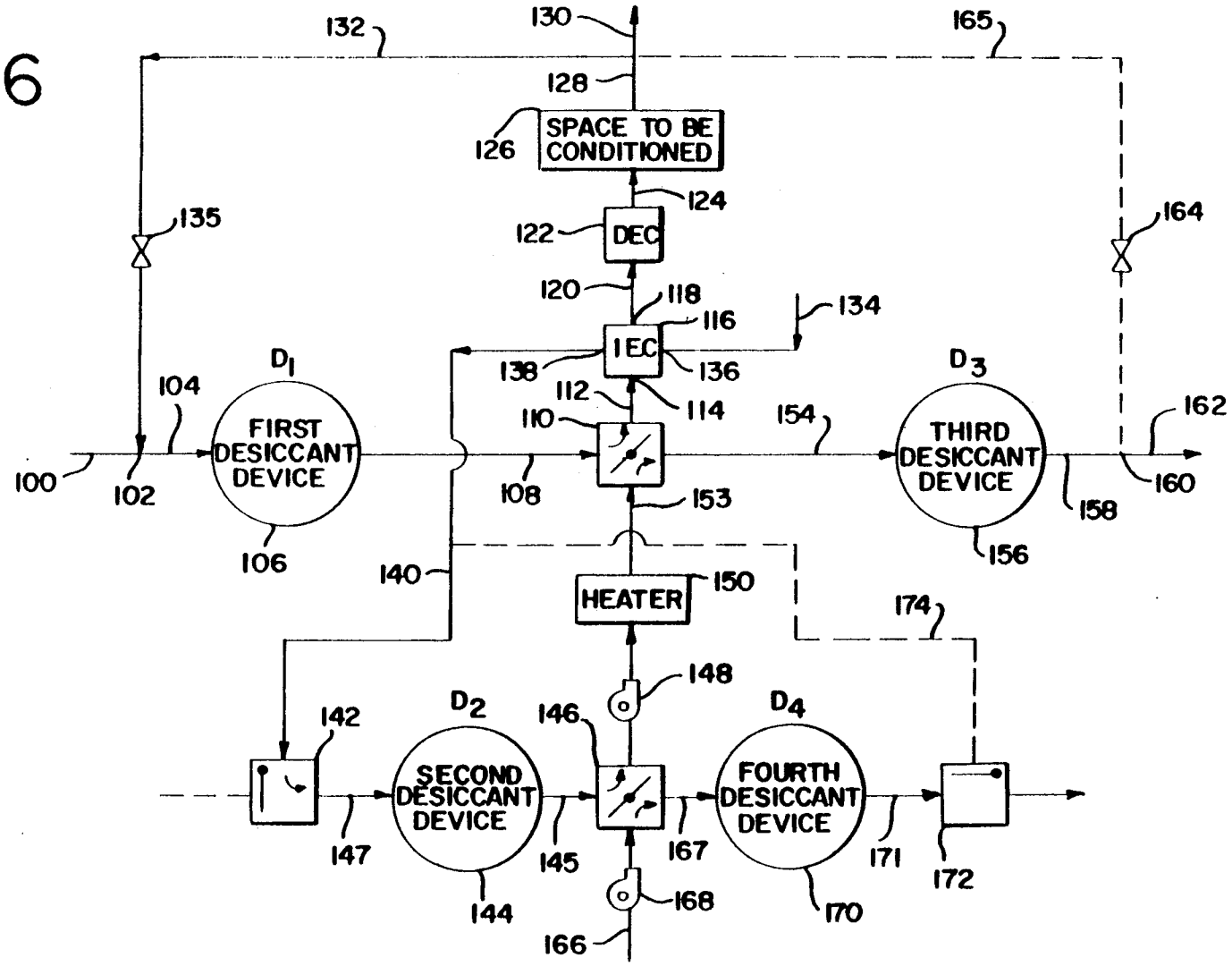
FIG. 6 is a schematic of a reversible desiccant based air conditioning system in accordance with the present invention while operating in the forward mode.
Figure 7:
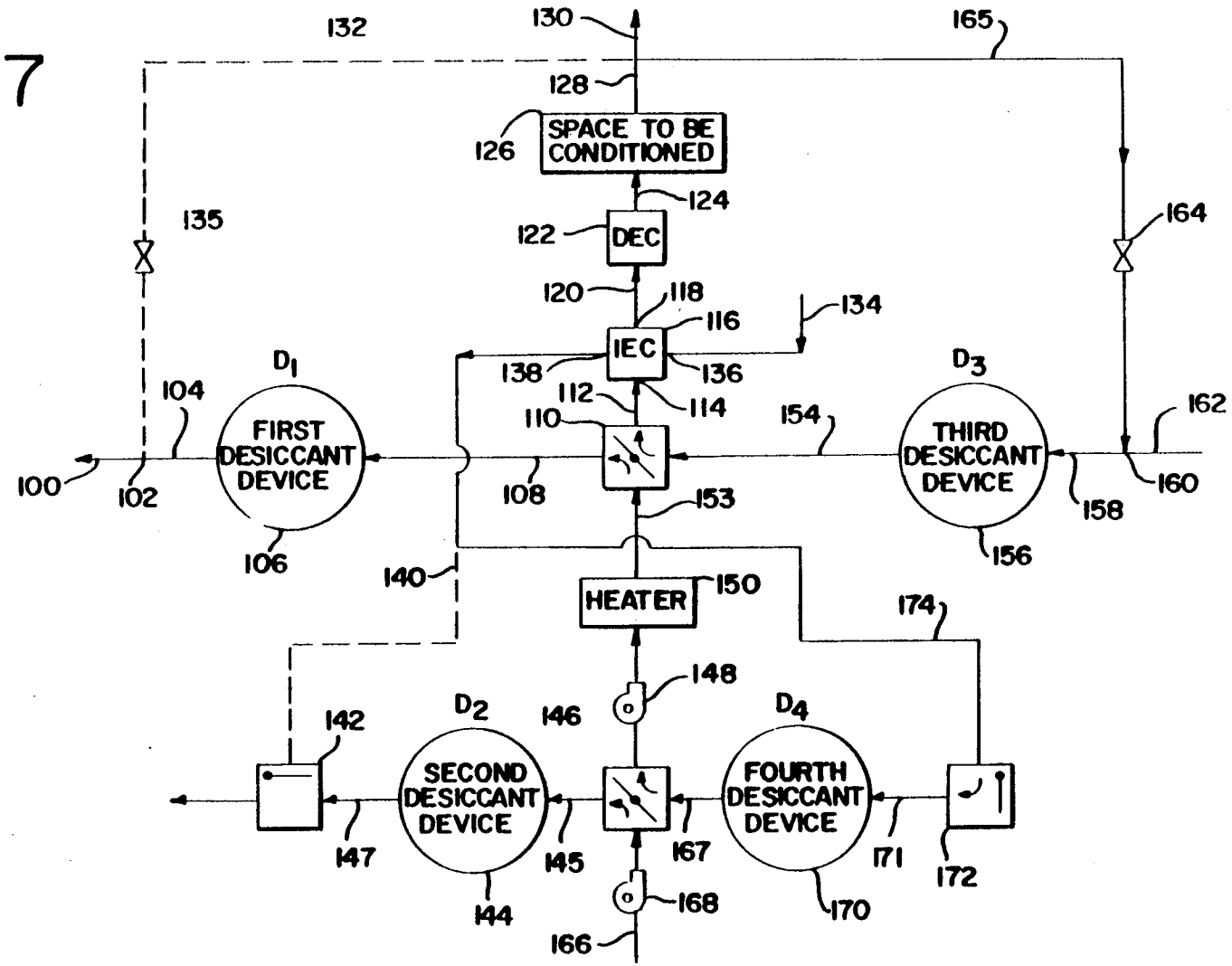
FIG. 7 is a schematic of a reversible desiccant based air conditioning system in accordance with the present invention while operating in the reverse mode.

Whereas in the primary embodiment the two desiccants were affixed to desiccant wheels and the processes of adsorption and desorption occurred simultaneously and continuously on each wheel, it is also possible to configure the present invention in such a manner that the desiccant wheels of the primary embodiment are not required. To do this, it is necessary to configure the system such that the flow streams can be periodically reversed to allow regeneration of the desiccants. One example of such a configuration is shown by FIG. 6 and FIG. 7. The system shown on these figures does not require the desiccant wheels of the primary embodiment; but, rather, the desiccant is contained in beds through which air may pass and contact the desiccant. FIG. 6 is a schematic diagram of this reversible system for the forward mode of operation. FIG. 7 is a schematic diagram of this reversible system for the reverse mode of operation.

As with the primary embodiment described previously, there are three flow streams in the alternative embodiment of the present invention shown on FIGS. 6 and 7. These streams include: a process air stream, a first regeneration air stream, and a second regeneration air stream. It should be noted that the steps by which each of these air streams are conditioned are similar to the same as in the primary embodiment. The differences between the primary embodiment and this reversible embodiment relate to the equipment utilized and the fact that the alternative embodiment must be periodically reversed.

There are four desiccant devices in this alternative embodiment. The first and third desiccant devices will contain a desiccant of normal moisture retention capacity and are used to dehumidify the process air stream. The second and fourth desiccant devices will generally contain a desiccant of high moisture retention capacity and are used to dehumidify the first regeneration air stream. At all times during the operation of this system, two of the four desiccant devices will be operating to dehumidify an air stream while the other two devices will be being regenerated.

Referring now to FIG. 6, the operation of the alternative embodiment of the present invention in the forward mode will now be explained. The solid lines shown on this system schematic represent flow paths which are used in the forward mode of operation of this system. The dotted lines represent flow paths which are not used in the forward mode operation but will be used in the reverse mode. In the forward mode, first desiccant device 106 is operating to dehumidify process air stream at 104, second desiccant device 144 is being used to dehumidify first regeneration air stream at 147, third desiccant device 156 is being regenerated by first regeneration air stream at 154, and fourth desiccant device 170 is being regenerated by second regeneration air stream at 167.

In the forward mode, the process air stream is made up of ambient air 100 and recirculated air 132. In the forward mode of operation, valve 135 is open to allow recirculated air 132 to mix with ambient air 100 at point 102 to form process air 104. The process air stream is then passed over first desiccant apparatus 106 which will most likely consist of a desiccant bed. A desiccant bed typically comprises a column which is filled with loose, spherical shaped desiccant beads. The bottom of the column is usually porous to allow air to pass vertically upward through the desiccant. Since the desiccant beads are mostly spherical in shape, passageways around the desiccant for air flow-through are created. Generally, the desiccant beads range in size from about 3 millimeters to 9 millimeters in diameter. The desiccant columns typically are in the size range of about 5 inches to several feet in diameter. In other instances, the desiccant contained in these beds is not in the form of loose beads but, rather, is deposited on a substrate. The substrate will be such as to maximize the surface area of the desiccant to allow for maximum contact with the air stream passing therethrough.

When the process air is passed over the desiccant contained in first desiccant apparatus 106, the desiccant adsorbs moisture from the process air stream thereby dehumidifying and warming this air stream. Upon leaving first desiccant apparatus 106, process air at 108 passes through switching means 110 which directs the process air to dry side inlet 114 of indirect evaporative cooler 116. Switching means 110 is typically a damper located within the air duct system. The damper is generally actuated by an electric motor in response to control signals, but could also be pneumatically controlled.

In passing through indirect evaporative cooler 116, the process air stream is cooled while the moisture content of the air remains constant. Cooled process air passes through the indirect evaporative cooler dry side exit 118 and passes through direct evaporative cooler 122 wherein the process air is adiabatically saturated with moisture; thereby, humidifying and further cooling the process air. Upon exiting direct evaporative cooler 122, air at 124 is fully conditioned and can be supplied to the space to be conditioned 126. Upon leaving this space, a certain amount of the process air is exhausted at 130 and the remainder is recirculated through valve 135 to be mixed with ambient air 100 to comprise process air to be conditioned 104.

First regeneration air stream 134 is comprised entirely of ambient air. First regeneration air stream 134 first passes through wet side 136 of indirect evaporative cooler 116 in which it becomes almost completely saturated with moisture and picks up the heat that had been transferred from the process air stream to the recirculated water in this cooler. Upon passing through wet side exit 138 of indirect evaporative cooler, first regeneration air stream at 140 passes through second switching device 142 which directs first regeneration air stream now at 147 to second desiccant device 144. The desiccant contained in second desiccant device 144 will typically operate at a higher moisture content than the desiccant used in first desiccant device 106. The desiccant in second desiccant device 144 adsorbs a significant amount of moisture from the almost saturated first regeneration air stream and, as a result, effects a substantial increase in the temperature of this air stream as it passes over the desiccant. After leaving second desiccant device 144, first regeneration air stream at 145 then passes through third switching means 146 which directs first regeneration air stream through air moving device 148 and through heater 150. Air moving device 148 is typically a fan or blower which is powered by an electrical motor. The fan could be either of a centrifugal, or "squirrel cage" type, or could be of the axial fan type.

In passing through the heater 150, the temperature of the first regeneration air stream is further increased. However, as in the primary embodiment, the amount of heat that must be added in this embodiment is significantly less than that required for typical systems. Upon leaving heater 150, the hot, dry first regeneration air stream at 153 passes through first switching device 110 which directs hot, dry first regeneration air stream now at 154 to third desiccant apparatus 156. As stated previously, the desiccant contained in third desiccant apparatus 156 is being regenerated by first regeneration air stream 154 in the forward mode of operation. As a result first regeneration air stream 154 evaporates and carries away moisture from the desiccant in third desiccant device 156 that this desiccant had adsorbed from the process air when the system was operating in the reverse mode. First regeneration air stream is exhausted at 158 upon leaving third desiccant device 156.

Second regeneration air stream 166 in the forward mode is also comprised entirely of ambient air. Second regeneration air stream 166 passes through third flow switching device 146 which directs second regeneration air stream to the fourth desiccant device 170. The desiccant of this fourth apparatus is also generally a desiccant with a higher moisture content than the desiccant contained in the first and third desiccant devices, 106 and 156 respectively. In the forward mode, the desiccant of fourth desiccant device 170 is in the process of being regenerated by the second regeneration air stream 166. Since the desiccant of fourth desiccant device 170 operates at a high moisture content, it can be generated in most cases by unheated ambient air. After passing through fourth desiccant device 170, second regeneration air stream 171 passes through fourth flow switching device 172 and is exhausted.

Referring now to FIG. 7, the operation of the alternative embodiment of the present invention in the reverse mode will now be explained. The solid lines shown on this system schematic represent flow paths which are used in the reverse mode of operation of this system. The dotted lines represent flow paths which were used in the forward mode operation. For the purpose of clarity, the reference numerals used on this schematic directly correspond to those used on the schematic of FIG. 6.

In the reverse mode, first desiccant device 106 is regenerated by first regeneration air stream at 108, second desiccant device 144 is regenerated by second regeneration air stream at 145, third desiccant device 156 is used to dehumidify process air at 158, and fourth desiccant device 170 is being used to dehumidify first regeneration air stream at 171.

In the reverse mode of operation, valve 164 is open to allow recirculated air 165 to mix with ambient air 162 at point 160 to form process air 158. Process air stream 158 is then passed over third desiccant device 156 which will most likely consist of a desiccant bed. When the process air stream 158 passes over the desiccant contained in third desiccant device 156, the desiccant adsorbs moisture from the process air stream thereby dehumidifying and warming this air stream. Upon leaving third desiccant apparatus 156, process air 154 passes through switching means 110, then through the dry side of indirect evaporative cooler 116, and then through direct evaporative cooler 122. Upon exiting direct evaporative cooler 122, the process air at 124 is fully conditioned and can be supplied to the space to be conditioned 126. Upon leaving this space, a certain amount of the process air is exhausted at 130 and the rest at 165 is recirculated to be mixed with ambient air 162.

First regeneration air stream 134 in the reverse mode is comprised entirely of ambient air. First regeneration air stream 134 first passes through the wet side at 136 of indirect evaporative cooler 116 and then through fourth switching device 172, which directs the air stream to fourth desiccant device 170 wherein this first regeneration air stream is dehumidified and warmed. After leaving fourth desiccant device 170, first regeneration air stream at 167 passes through third switching means 146 which directs first regeneration air stream through air moving means 148 and through heater 150. Upon leaving heater 150, hot and dry first regeneration air stream at 153 passes through first switching device 110 which directs first regeneration air stream to first desiccant apparatus 106. In the reverse mode, the desiccant contained in first desiccant apparatus 106 is being regenerated by first regeneration air stream at 108. First regeneration air stream is exhausted at 100 upon leaving first desiccant device 106.

Second regeneration air stream 166 in the reverse mode is also comprised entirely of ambient air. Second regeneration air stream 166 passes through third flow switching device 146 which directs second regeneration air stream now at 145 to second desiccant device 144. In the reverse mode, the desiccant of second desiccant device 144 is in the process of being regenerated by second regeneration air stream 145. After passing through second desiccant device 144, second regeneration air stream at 147 passes through second flow switching device 142 and is exhausted.

The foregoing description has been given to clearly define and completely describe the preferred embodiment and one alternative embodiment of the present invention. Various modifications may be made without departing from the scope and spirit of the invention which is defined in the following claims.

I claim:

1. An improved method of conditioning air utilizing a reversible process wherein in the forward direction the method comprises the steps of:

dehumidifying the air to be conditioned by contacting it with a first air drying means, then cooling this air by passing it through a dry side of an indirect evaporative cooler means, then further cooling and humidifying this air by passing it through a direct evaporative cooler means, after which the air is fully conditioned;

while at the same time a second air stream comprising ambient air which is to be used for regenerating a third air drying means is first passed through a wet side of said indirect evaporative cooler wherein it obtains moisture and heat, and then is dehumidified by contacting it with a second air drying means, then is heated by a heating means, and then is used to regenerate said third air drying means by contacting the second air stream with said third air drying means;

while at the same time a fourth air drying means is regenerated by contacting it with ambient air.

2. The method of claim 1 wherein in the reverse direction the method comprises the steps of:

dehumidifying the air to be conditioned by contacting it with said third air drying means, cooling the dehumidified air by passing it through the dry side of said indirect evaporative cooler means, and further cooling and humidifying the air being conditioned by passing it through a direct evaporative cooler means;

while at the same time a second air stream comprising ambient air is first warmed and humidified on the wet side of the indirect evaporative cooler, then is dehumidified in the fourth air drying means, and then is heated and used to regenerate the first air drying means;

while at the same time a third air stream comprising ambient air is used to regenerate the second air drying means.

3. The method of claim 1 wherein the first, second, third, and fourth air drying means are desiccants.

4. The method of claim 1 wherein the first air drying means is of the same type as the third air drying means and wherein the second air drying means is of the same type as the fourth air drying means.

5. The method of claim 1 wherein the first and third air drying means are of a type different from the second and fourth air drying means.

6. The method of claim 5 wherein the first and third air drying means have different moisture retention capacities than the second and fourth air drying means.

7. The method of claim 6 wherein the moisture retention capacity of the second and fourth air drying means is greater than the moisture retention capacity of the first and third air drying means.

8. The method of claim 3 where the desiccants are selected from a group comprising silica gel, activated alumina, molecular sieves, and hygroscopic salts.

9. A reversible air conditioning system comprising a first, second, third, and fourth air drying means each with an inlet and outlet for air flow through, an indirect evaporative cooling means with a wet side having an inlet and outlet for air flow through and a dry side having an inlet and outlet for air flow through, a direct evaporative cooling means with an inlet and outlet for air flow through, a heater means with an inlet through, a first, second, third, and fourth flow switching means each with an inlet and outlet for air flow through and provided such that in the forward mode of operation the first flow switching means connects the first air drying means outlet to the indirect evaporative cooler means dry side inlet and connects the heater means outlet to the third air drying means outlet, and the second flow switching means connects the second air drying means outlet to the heating means inlet and connects an ambient air inlet to the fourth air drying means outlet, and the third flow switching means connects the indirect evaporative cooling means wet side outlet to the second air drying means inlet, and the fourth flow switching means connects the fourth air drying means inlet to an opening for exhausting air.

10. The system of claim 9 wherein in a reverse mode of operation said first flow switching means connects the heater means outlet to the first air drying means outlet and connects the third air drying means outlet to the indirect evaporative cooling means dry side inlet, said second flow switching means connects the fourth air drying means outlet to the heating means inlet and connects an ambient air inlet to the second air drying means outlet, the third flow switching means connects the second air drying means inlet to an opening for exhausting air, and the fourth flow switching means connects the indirect evaporative cooling means wet side outlet to the fourth air drying means inlet.

11. The system of claim 9 wherein the first, second, third, and fourth air drying means are desiccants.

12. The system of claim 9 wherein the first air drying means is of the same type as the third air drying means and wherein the second air drying means is of the same type as the fourth air drying means.

13. The system of claim 9 wherein the first and third air drying means are of a type different from the second and fourth air drying means.

14. The system of claim 13 wherein the first and third air drying means have different moisture retention capacities than the second and forth air drying means.

15. The system of claim 14 wherein the moisture retention capacity of the second and fourth air drying means is greater than the moisture retention capacity of the first and third air drying means.

16. The system of claim 11 where the desiccants are selected from a group comprising silica gel, activated alumina, molecular sieves, and hygroscopic salts.

* * * * *